United States Patent [19]

Helling et al.

[11] Patent Number: 5,016,428

[45] Date of Patent: May 21, 1991

[54] INFLATING APPARATUS AND METHOD

[76] Inventors: Robert W. Helling, 11214 Quivas Way, Westminster, Colo. 80234; Daniel J. Helling, 8288 Pecos St., Denver, Colo. 80221

[21] Appl. No.: 460,584

[22] Filed: Jan. 3, 1990

[51] Int. Cl.[5] ..... B65B 67/12; B65B 67/06; B65B 31/06; B65B 43/26

[52] U.S. Cl. ..... 53/403; 53/411; 53/469; 53/79; 53/88; 53/131.1; 141/173; 427/160

[58] Field of Search ..... 53/403, 459, 79, 88, 53/459, 469, 472, 483, 385, 131, 411; 427/230, 160; 141/173

[56] References Cited

U.S. PATENT DOCUMENTS

| | | | |
|---|---|---|---|
| 3,380,490 | 4/1968 | Ellenberg et al. | 141/173 X |
| 3,536,110 | 10/1970 | West | 141/173 X |
| 3,580,303 | 5/1971 | Roberge | 141/173 |
| 3,616,823 | 11/1971 | Iacono | 141/173 X |
| 3,932,977 | 1/1976 | Ringler | 53/88 X |
| 4,937,026 | 6/1990 | Goossens et al. | 427/160 X |

FOREIGN PATENT DOCUMENTS 274000 7/1927 United Kingdom .

*Primary Examiner*—Horace M. Culver

*Attorney, Agent, or Firm*—Fields, Lewis Pittenger & Rost

[57] ABSTRACT

Inflating apparatus and method disclosed has a base preferably mounted on the side of a gas-filled tank and located approximately at or below waist level. A balloon is mounted on a mounting sleeve on the base. The balloon is mounted so that an end section of the neck portion is expanded and everted back over a top lip of the mounting sleeve to form an air-tight connection with the mounting sleeve and the neck portion extends down through the sleeve. If a coating material is desired on the outside of the balloon the coating material is initially placed inside the balloon, the balloon is mounted on the top of the sleeve and turned inside out by being passed down through the mounting sleeve before inflation. A fill plug is pressed down against an end section of the balloon on top of the mounting sleeve to form an air-tight seal and gas under pressure is selectively passed into the balloon. A size gauge indicates when the balloon is a selected size. A closure in the form of a twist ring twists the neck of the inflated balloon. A knot tying device is provided to tie a knot in the neck of the balloon to close off the fill opening and in the alternative a tie line may be used to tie the neck portion of the balloon closed.

23 Claims, 3 Drawing Sheets

INFLATING APPARATUS AND METHOD

TECHNICAL FIELD

This invention relates to a novel and improved method and apparatus for inflating balloons and the like.

BACKGROUND ART

Balloons have heretofore been inflated with a gas such as air or helium and tied closed primarily using manual procedures. Prior balloon inflating practices have heretofore usually been conducted at face level and this technique has sometimes resulted in personal injuries ranging from minor cuts and abrasions to the eyes and ear loss. Some other problems associated with filling balloons are they tend to leak at the tie at the fill end portion and a further problem is that ultraviolet rays tend to attack the rubber in clear latex balloons and make them opaque. Further problems include the usual difficulty in supporting a balloon during inflation and difficulty in tying or closing off the fill end portion of an inflated balloon.

DISCLOSURE OF THE INVENTION

A method and apparatus disclosed for inflating balloons includes the use of a base that preferably readily mounts on the side of a gas-filled tank so that the inflating takes place at or near waist level. The base disclosed includes a flat support plate that carries a mounting sleeve arranged for supporting a balloon by having an open end portion that is expanded and spread over a top lip portion of the sleeve to form a seal and a section of the neck portion is everted back through the sleeve during inflation. A fill plug is moved by a hold-down assembly. The fill plug presses an open end section of the balloon against the mounting sleeve to form an air-tight seal and passes a gas under pressure from the tank into the balloon. There is further provided a closure assembly to twist the neck portion of the balloon after inflation, a knot tying structure for tying the twisted neck portion in a knot to close the inflated balloon and a size gauge to provide for a selected balloon size.

BRIEF DESCRIPTION OF THE DRAWINGS

Details of this invention are described in connection with the accompanying drawings in which like parts bear similar reference numerals and in which.

DETAILED DESCRIPTION

Figure 1:
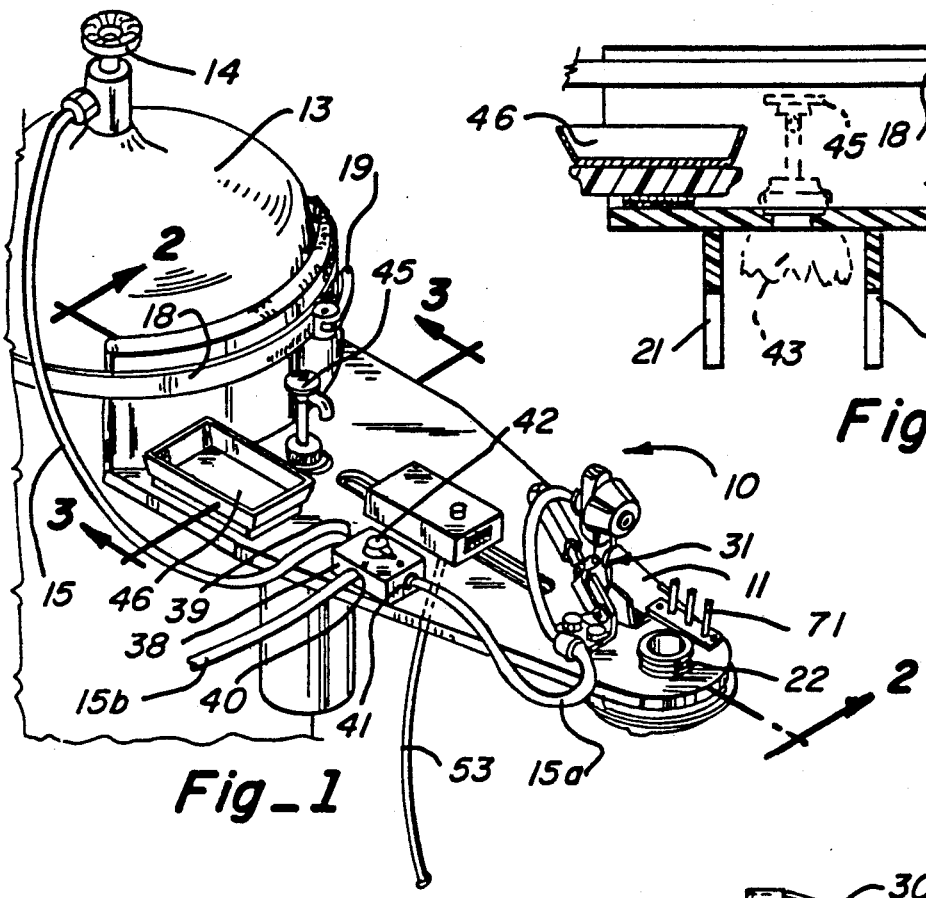
FIG. 1 is a top perspective view of inflating apparatus embodying features of the present invention mounted on a gas filled tank with the fill plug shown in an up position.
Figure 3:
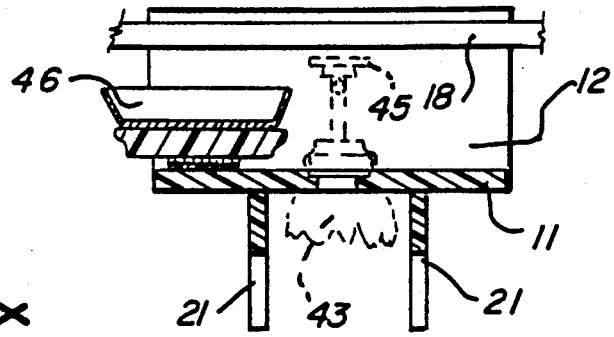
FIG. 3 is a sectional view taken along line 3—3 of FIG. 1.

Referring now to the drawings there is shown apparatus for inflating a balloon B which apparatus includes a base 10 having an elongated horizontally positioned flat support plate 11 and an upstanding back plate 12 secured at the rear end of the support plate 11. The term balloon as used herein is intended to refer to any type of inflatable envelope capable of being inflated with a gas or air but the present invention is particularly suited for balloons made of an elastomeric material, including latex and rubber. Back plate 12 is generally curved to be complementary with or to conform to the curvature of the side wall of a gas-filled tank 13 on which it mounts. The tank 13 typically is provided with a control valve 14 on the top and a supply line 15 through which the gas under pressure is delivered. A strap 18 with a clamping lever 19 is used to releasably engage and rigidly secure the back plate 12 to the side wall of the tank. While this mounting for plate 12 is preferred because the tank will supply the gas under pressure to fill the balloon, it is understood that other arrangements could be used for mounting of a support plate 11 in a generally horizontal position which may include a table top and use of a C-clamp or the like.

The support plate 11 shown has flat top and bottom surfaces and a pair of parallel spaced reinforcing members 21 extend along and are affixed to the underside of the support plate and have straight rear ends that are coextensive with the back plate and butt up against the outside of the tank 13. A typical gas other than air for the tank 13 would be helium. A typical tank of this type is about four to five feet in height and the support plate can be positioned such as about three feet from the supporting surface so that the inflation takes place at or below waist level rather than at the eye level of the user to avoid potential bodily injury to the user.

A balloon mounting sleeve 22 is rigidly mounted in an opening 23 in plate 11 adjacent a free or unsupported end portion thereof. The sleeve 22 has a through passage 25, a top lip portion 26 extending above the top surface of the support plate and a bottom flange portion 27 below the bottom surface of the support plate.

Figure 7:
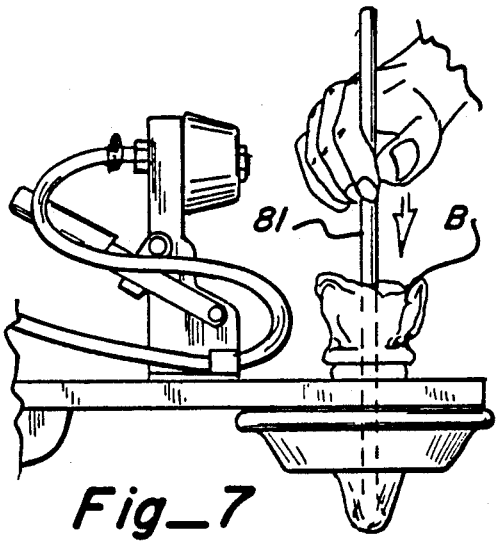
FIG. 7 is a side elevational view of a portion of the apparatus with the balloon being forced down through the mounting sleeve and in a partially everted condition.

The balloon B has a flexible neck portion that terminates in a flexible annular O-ring section defining the fill opening of the balloon. To place the balloon on the mounting sleeve a section of the neck portion and the O-ring section are expanded or stretched and slipped over the top lip portion 26 of the mounting sleeve and the O-ring section nests in an annular recess 26*a* in the outer peripheral surface of the top lip portion. The external dimension of the sleeve exceeds that of the O-ring section and neck portion of the balloon so expanding or stretching placement of these portions of the balloon on the mounting sleeve forms an air-tight seal between the balloon and sleeve and holds the balloon in place during the inflation procedure. As seen in FIG. 7, the balloon is everted back over the lip portion and passed down through the sleeve passage as by using a rod 81 so as to become everted or inside out and as such the balloon is firmly secured to the mounting sleeve. An alternative procedure to mount the balloon on the sleeve is to move the neck portion from below up through passage 25 of the sleeve, evert the neck portion back over the top lip portion of the sleeve and insert the O-ring section into recess 26*a*. A pull tab P extends along the inside of the neck portion inside sleeve 22 and extends up and outside the sleeve as seen in FIG. 9 to facilitate the removal of the inflated balloon from the sleeve.

Figure 2:
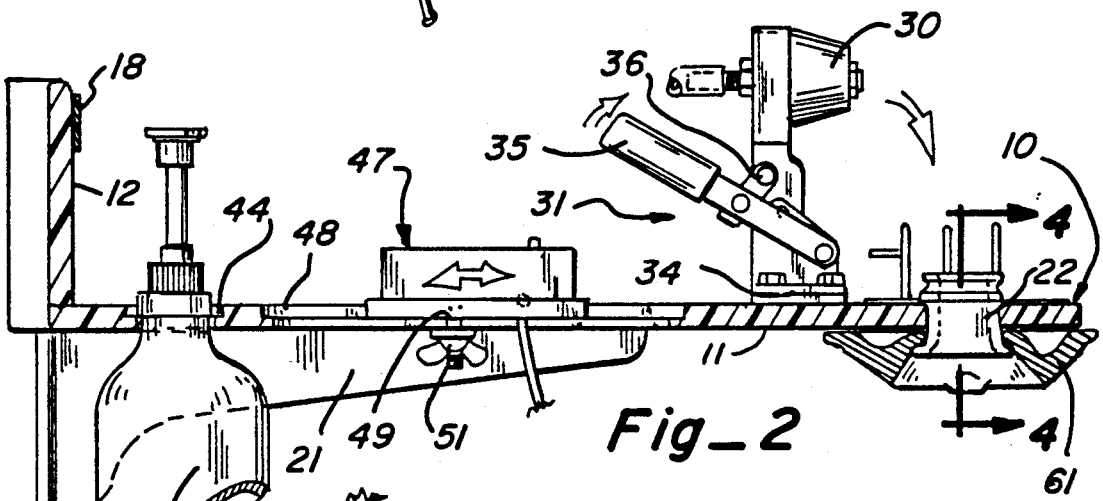
FIG. 2 is a sectional view taken along line 2—2 of FIG. 1.
Figure 4:
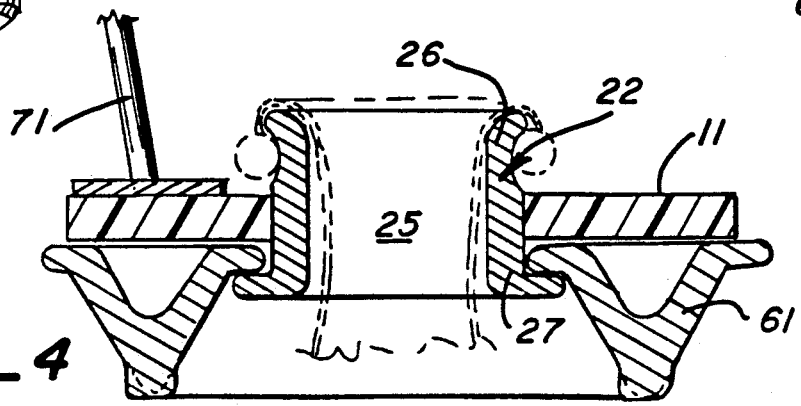
FIG. 4 is a sectional view taken along line 4—4 of FIG. 2.
Figure 9:
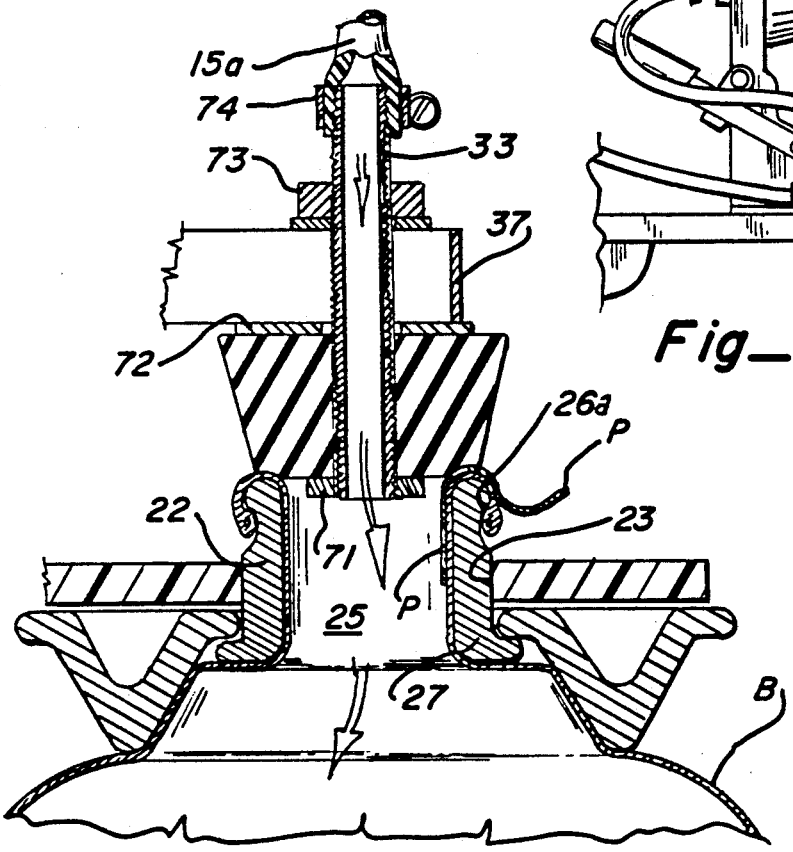
FIG. 9 is a sectional view through the mounting sleeve showing the fill plug in a down position for the inflating of the balloon.

The balloon B is inflated by the use of a fill plug 30 mounted on the end of a hold-down assembly 31 that is arranged to move the plug 30 between an up position as shown in FIGS. 1 and 2 and a down position shown in FIG. 9. The fill plug 30 has a center through hole or fill passage through which a fill pipe section 33 having external threads extends to deliver a gas under pressure into the balloon as is illustrated in FIG. 9. The plug 30 external threads on pipe section 33 to adjust the has an internally threaded bore and threads along the hold down pressure. A nut 81 with associated washer threads on the bottom and a nut 82 with associated washer threads on the top to lock the plug in place. A top nut 83 with associated washer holds the pipe section to the support 37. A spring clip clamp 74 holds pipe section 15*a* to the input end of the fill pipe section 33.

The hold-down assembly 31 is mounted adjacent the mounting sleeve. Assembly 31 includes a base 34 rigidly mounted on top of the support plate adjacent the mounting sleeve, a control lever 35 pivotally mounted at one end to the base 34 and a link 36 pivotally connected at both ends between the control lever 35 and a support head 37 on which the fill plug 30 is mounted so that the movement of the lever raises and lowers the fill plug 30 as shown. In the down position the linkage locks the plug in a down clamping position. The hold-down assembly 31 shown is a Series 207 product of the Destaco Company. In use as seen in FIG. 9, the fill plug 30 moves down and becomes coaxially aligned with the centerline of the passage and the bottom surface of plug 30 is forced against an annular section of the everted balloon so a section of the balloon is clamped between the fill plug and the top of the mounting sleeve to form an air-tight seal.

A control valve 38 is mounted on the support plate 11 and preferably has two input ports 39 and 40 and a single output port 41. The supply line 15 from the tank is shown coupled to inlet port 39. A supply line section 15*a* connects from the outlet port 41 to the inlet of fill pipe section 33 inside the fill plug 30. The other inlet port 40 will receive another gas under pressure such as air from line 15*b* coupled to port 40. A control lever 42 has selected settings to stop the flow or direct the flow from either inlet portion through the outlet portion 40.

A dispenser 43 containing a coating material is mounted in an opening 44 on the base. The dispenser 43 has a dispensing spout 45 through which this coating material is initially inserted into the inside of the balloon if the coating option is used. A drip pan 46 mounted on the support plate adjacent spout 45 is provided for any excess of the coating material that might drip out when said material is being inserted into the balloon B. A coating material suitable for this purpose is an evaporating aqueous solution containing liquid silicone, water and an alcohol carrier. A typical solution would be a liquid silicone of about 10% by weight, water of about 85% by weight, and an alcohol carrier of about 5% by weight. This coating preserves and protects the latex balloon and prevents same from becoming opaque. A further feature would be to add a water soluble die to the solution to attain the desired color.

A size gauge 47 is mounted to move along the support plate 11 in an elongated slot 48 extending longitudinally of plate 11. The gauge has a rectangular housing with a bolt 49 that extends through the slot 48 and a nut 51 secures the housing at a selected position. The size gauge 47 shown is adapted to provide audible (alarm) and visual (light) signals indicating that the balloon has been inflated to a selected size. The gauge has depending pivot arm 59 that is engaged by the balloon. The electric circuit for the size gauge 47 includes a DC battery 56, signal light 57 and audible alarm or signal device 58 such as a bell together with the pivot arm 53 that triggers a normally-open electric switch 60 to close the switch and turn on the light and alarm when the balloon reaches a certain size or diameter. The gauge is adjustable by moving the position of the housing of size gauge 47 along the slot 48 and tightening the nut 51.

A closure assembly for twisting the neck portion of the balloon has a twist ring 61 mounted for rotation on the bottom flange 27. The ring has two bulbous friction portions 62 which are disposed at 180° in relation to one another which engage the body of the inflated balloon and twist the neck portion of the balloon for closing the open end.

Figure 14:
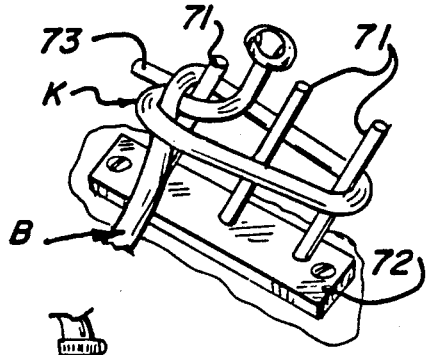
FIG. 14 is an enlarged perspective view of a one-hand knot tying structure.
Figure 11:
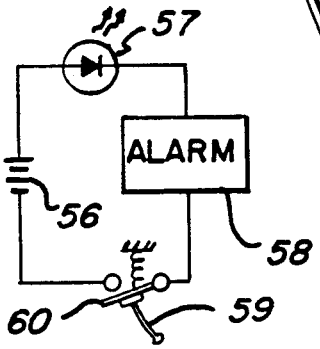
FIG. 11 is a schematic electric circuit diagram for the size gauge.
Figure 13:
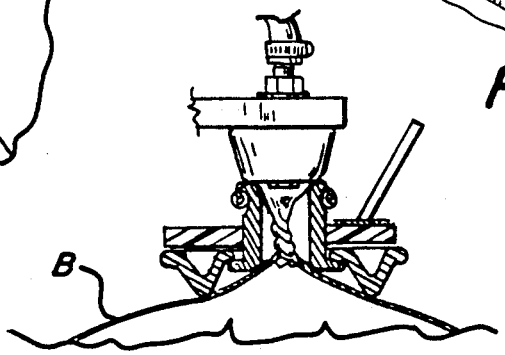
FIG. 13 is a sectional view taken along line 13—13 of FIG. 10 showing the neck portion of the balloon twisted.
Figure 12:
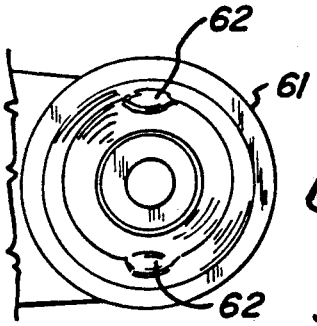
FIG. 12 is a sectional view taken along line 12—12 of FIG. 10.
Figure 15:
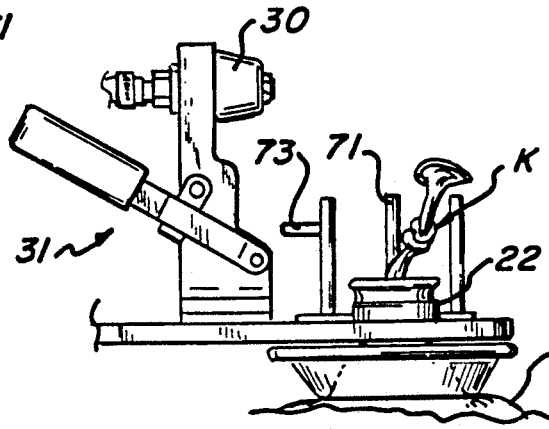
FIG. 15 is a side elevational view showing the fill plug in an up position and the neck portion of the inflated balloon tied in a knot to close the fill opening of the balloon.

A knot tying device is mounted on the support plate which includes three upstanding and outwardly inclined posts 71 that are spaced from one another and mounted on a common base 72 secured to the top of the support plate as by using bolts or the like. One of the posts has a stub 73 extending horizontally out therefrom. A procedure for tying the balloon is to loop the neck portion over the stub 73, around the posts to form a loop and then back through the loop to form the knot K as is shown in FIG. 14. The knot may then readily be raised over the tops of the posts. This may be done by having the user use only one hand and may be referred to as a one hand knot-tying device.

Figure 5:
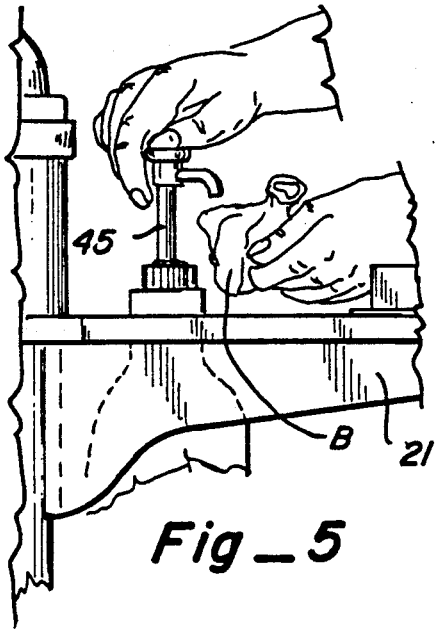
FIG. 5 is a side elevational view of a portion of the apparatus showing the insertion of a coating material into the inside of a balloon.

In the procedure for filling the balloon using the above described apparatus it is understood that the balloon may be inflated without applying a coating material but if a coating material is desired on the outside of the balloon a selected quantity of coating material is dispensed into the inside of a balloon from dispenser 43 via spout 45 (FIG. 5).

The balloon is mounted on the mounting sleeve in either of two ways. If no exterior coating is applied the neck portion of the balloon B may be passed up through the bottom of the through bore of the mounting sleeve and everted over the top lip of the mounting sleeve.

Figure 6:
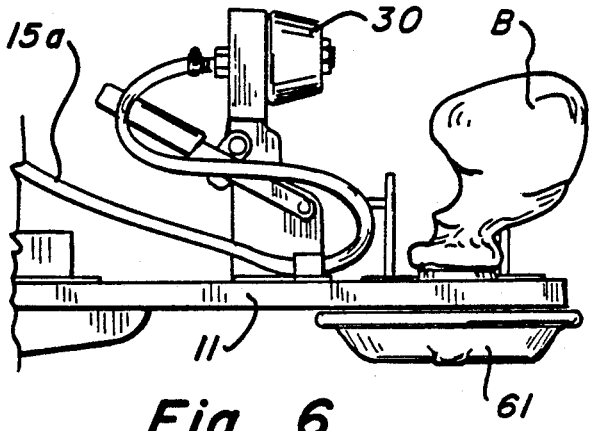
FIG. 6 is a side elevational view of a portion of the apparatus with a balloon in an initial position on the top lip portion of the mounting sleeve.

Alternately, the balloon may be placed on the mounting sleeve from above as shown in FIG. 6 and everted by passing the balloon through the sleeve passage as by using a rod 81 (FIG. 7). The second procedure is usually followed after a coating material has been placed on the inside of the balloon.

Figure 8:
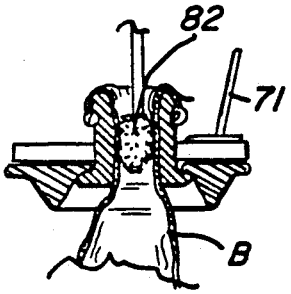
FIG. 8 is a sectional view through the mounting sleeve showing the application of the coating material to the inside of the neck of the balloon.
Figure 10:
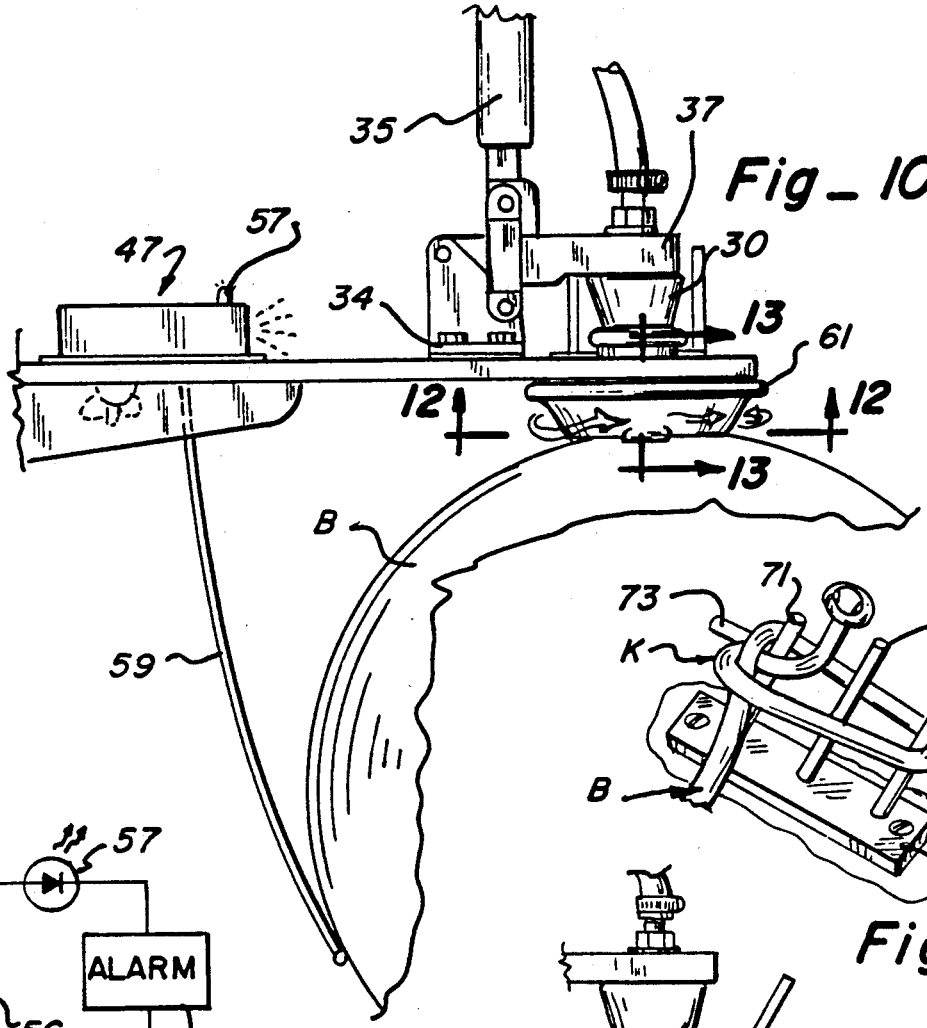
FIG. 10 is a side elevational view showing an inflated balloon and the actuation of the size gauge.

Preferably a quantity of the coating material is then applied along the inside of the neck of the balloon using a swab 82 (FIG. 8) before inflation.

The fill plug is then moved down against the annular section of the balloon (FIG. 9) so that the annular section of the balloon is clamped between the plug and a top annular edge of sleeve 22 to form an air-tight seal. The control valve lever 42 is actuated to inflate the balloon.

The inflated balloon may be closed by either rotating the twist ring 61 to twist the neck portion of the inflated portion of the balloon with respect to the body or a tie device may be passed under ring 61 and tied.

The fill plug 30 is then raised, the pull tab P pulled to release the balloon from the sleeve. If a ti device is not used a knot K is tied in the twisted portion or a tie cap may be used. The tied balloon is then pulled down and away from the sleeve 22 using the pull tab P.

Although the present invention has been described with a certain degree of particularity, it is understood that the present disclosure has been made by way of example and that changes in details of structure may be made without departing from the spirit thereof.

What is claimed is:

1. Apparatus for inflating a balloon comprising:

means for supporting a balloon having a main body from which extends a neck portion terminating in an annular end section defining a fill opening, said means for supporting including a mounting sleeve having an inside through passage and a top lip portion with said annular end section being expanded around and compressing against an outer peripheral surface of said top lip portion to form an air-tight seal, said neck portion extending over a top edge portion of said top lip portion and downwardly through said through passage and said main body being disposed below said mounting sleeve, means for inflating said balloon with a gas via said fill opening, and means for closing said fill opening in said balloon to retain the gas in the inflated balloon.

2. Apparatus as set forth in claim 1, said annular end section being positioned on said top lip portion and said main body portion being passed downwardly through said passage to turn said balloon inside out.

3. Apparatus as set forth in claim 2 wherein said balloon is initially provided with a quantity of coating material so that the coating material is on the outside after being turned inside out.

4. Apparatus as set forth in claim 1 further including means for providing an indication when the balloon has been inflated to a selected size.

5. Apparatus as set forth in claim 1 further including dispensing means for a coating material for use in inserting said quantity of coating material into the inside of the balloon.

6. Apparatus as set forth in claim 3 further including a drip pan adjacent said dispensing means to collect any drips of coating material.

7. Apparatus as set forth in claim 1 wherein said means for supporting includes a support plate, a balloon mounting sleeve in said plate, said sleeve having a through, passage, a top lip portion extending above said plate and a bottom flange portion extending below said plate.

8. Apparatus as set forth in claim 7 including means for releasably attaching said support plate to the side of a tank containing gas used in inflating said balloon.

9. Apparatus as set forth in claim 8 including means for releasably attaching includes an upstanding backing plate attached to one end of said support plate and a strap and a releasable clamp operatively associated with said strap to clamp said backing plate to the side of said tank.

10. Apparatus as set forth in claim 1 wherein said means for inflating includes a fill plug movable between a raised position and a lowered position, said plug having a fill passage coupled to a gas supply line whereby a gas is passed via said fill plug in the lowered position from said gas supply line into said balloon.

11. Apparatus as set forth in claim 10 wherein said fill plug is mounted on the lever arm of a clamp assembly having linkage and a movable lever that moves said plug through a selected arc between upper and lower positions and locks said fill plug in said lower position.

12. Apparatus as set forth in claim 11 including a fill pipe section adjustably mounted to be moved relative to said fill plug and locked at a selected position to adjust the hold-down pressure exerted against the balloon section in the down position.

13. Apparatus as set forth in claim 10 further including control valve means to regulate the flow of gas under pressure to said fill plug.

14. Apparatus as set forth in claim 1 wherein said means for closing includes a rotatable ring having friction means to engage an inflated body portion of the balloon to twist a neck portion of the inflated balloon as said ring is rotated.

15. Apparatus as set forth in claim 14 wherein said friction means includes two bulbous bodies disposed on said ring at positions located in an arc 180 degrees relative to one another.

16. Apparatus as set forth in claim 3 wherein said coating material is an evaporating aqueous solution containing liquid silicone, water and an alcohol carrier.

17. Apparatus as set forth in claim 1 wherein said means for supporting includes a base having a support plate, a backing plate at one end of the support plate and reinforcing plates extending along the underside of the support plate and having ends coextensive with said backing plate.

18. Apparatus as set forth in claim 1 including a tie device including spaced upright posts and a stub shaft extending out from one of said posts whereby a neck portion of the balloon is passed about said posts and stub shaft to form a closure knot after the balloon is inflated.

19. Apparatus for inflating a balloon with a gas comprising:

a base, a mounting sleeve in said base arranged for supporting a balloon during the everting and inflation, said balloon having a coating material initially on the inside, said sleeve having a through passage, a top lip extending above said base and a bottom flange extending below said base, a fill plug on a clamp assembly mounted on said base adjacent said mounting sleeve, said plug being arranged to move between a raised position and a lowered fill position, said plug having a fill passage coupled to supply line from a gas supply, said balloon having a neck portion mounted on said top lip to provide a fill opening for said balloon with said balloon having been everted by being and passed through said mounting sleeve passage whereby said coating material is on the exterior of said balloon, said plug being in the lowered position over said fill opening for inflation via said fill passage, a control valve on said base arranged to selectively control the flow of the inflating gas through said supply line and fill plug, and a closure assembly including a ring mounted to rotate on said bottom flange relative to said mounting sleeve to engage and twist the inflated balloon at the neck portion to close said fill opening.

20. A method of inflating a balloon comprising the steps of:

expanding a flexible section of a neck portion terminating in an annular end section defining a fill opening of a balloon over an outer peripheral surface of a mounting sleeve having an inside through passage with said neck portion extending over a top edge portion of said sleeve and down through said through passage of the mounting sleeve to form an air-tight seal between the balloon and the sleeve, moving a fill plug down against a section of the balloon on said top edge portion of the mounting sleeve to clamp the balloon between the plug and sleeve to form an air-tight seal between said balloon plug and mounting sleeve, passing a gas into the balloon via said fill plug, and closing the fill opening of the balloon to retain the gas in the inflated balloon.

21. A method as set forth in claim 20 wherein said neck portion is first passed up through said mounting sleeve and said annular end portion is then everted back over the top of said mounting sleeve.

22. A method as set forth in claim 20 wherein said annular end section is first expanded over said section and said balloon is passed down through said mounting sleeve to be turned inside out.

23. A method of inflating a balloon comprising the steps of:

introducing a quantity of coating material into the inside of a balloon via a fill opening in the balloon, everting the balloon so that the coating material is on the outside of the balloon, inflating the balloon with a gas, and closing the fill opening to retain the gas in the inflated balloon.

* * * * *